US007536806B2

(12) United States Patent
Juppi et al.

(10) Patent No.: US 7,536,806 B2
(45) Date of Patent: May 26, 2009

(54) ARRANGEMENT IN A PAPER MACHINE

(75) Inventors: Kari Juppi, Palokka (FI); Antti Komulainen, Keuruu (FI); Markku Lummila, Jyväskylä (FI); Michael Odell, Jyväskylä (FI); Martti Salminen, Jyväskylä (FI); Riikka Antikainen, Muurame (FI); Petter Honkalampi, Kinkomaa (FI)

(73) Assignee: Metso Paper, Inc., Helsinki (FI)

( * ) Notice: Subject to any disclaimer, the term of this patent is extended or adjusted under 35 U.S.C. 154(b) by 317 days.

(21) Appl. No.: 10/597,175

(22) PCT Filed: Jan. 14, 2005

(86) PCT No.: PCT/IF2005/050006

§ 371 (c)(1),
(2), (4) Date: Aug. 31, 2006

(87) PCT Pub. No.: WO2005/068713

PCT Pub. Date: Jul. 28, 2005

(65) Prior Publication Data

US 2007/0084078 A1 Apr. 19, 2007

(30) Foreign Application Priority Data

Jan. 15, 2004 (FI) ..... 20040049
Apr. 23, 2004 (FI) ..... 20045148

(51) Int. Cl.
*D06F 58/00* (2006.01)
*F26B 3/00* (2006.01)

(52) U.S. Cl. ..... 34/114; 34/115; 34/464; 34/619; 34/620

(58) Field of Classification Search ..... 34/114, 34/115, 116, 123, 619, 620, 444, 464; 162/207, 162/206, 359.1
See application file for complete search history.

(56) References Cited

U.S. PATENT DOCUMENTS 4,154,645 A 5/1979 Kankaanpää

(Continued)

FOREIGN PATENT DOCUMENTS

CA 2053239 C 2/1991

(Continued)

OTHER PUBLICATIONS

Search Report issued in Finnish App. No. 20040049.

(Continued)

*Primary Examiner*—Jiping Lu
(74) *Attorney, Agent, or Firm*—Stiennon & Stiennon

(57) ABSTRACT

An arrangement and method for improving runnability, and dryer section length, by using a vertical impingement dryer before a first dryer cylinder of a group of dryer cylinders. After a pressing section, the web is dried with a pre-impingement dryer, closely followed by a vertical impingement dryer, which is closely following by the first dryer cylinder. The pre-impingement dryer and vertical impingement dryer of the first dryer cylinder to have a drying temperature of approximately 80° C. with no undesirable sticking to the dryer cylinder. The pre-impingement dryer can be arranged to dry a first side of the web, and a vertical impingement dryer after the first dryer cylinder is arranged to dry a second side of the web. The impingement drying takes place directly against the web without an intervening fabric.

18 Claims, 11 Drawing Sheets

U.S. PATENT DOCUMENTS

| | | | |
|---|---|---|---|
| 4,361,466 | A | 11/1982 | Wong et al. |
| 4,830,709 | A | 5/1989 | Turner et al. |
| 5,064,502 | A | 11/1991 | Turner |
| 5,256,257 | A | 10/1993 | Schiel |
| 5,865,955 | A | 2/1999 | Ilvespaa et al. |
| 6,442,865 | B1 | 9/2002 | Wolf et al. |
| 7,036,242 | B2 | 5/2006 | Komulainen et al. |

FOREIGN PATENT DOCUMENTS

| | | | |
|---|---|---|---|
| DE | 414097 | C1 | 5/1925 |
| FI | 20040049 | | 1/2004 |
| FI | 20045148 | | 4/2004 |
| GB | 2094364 | A | 9/1982 |
| WO | 98/56983 | A1 | 12/1998 |
| WO | 02/36880 | A1 | 5/2002 |
| WO | 2005/068713 | A1 | 7/2005 |

OTHER PUBLICATIONS

Search Report issued in Finnish App. No. 20040224.
Search Report issued in Finnish App. No. 20040225.
Search Report issued in Finnish App. No. 20040337.
Search Report issued in Finnish App. No. 20045148.
International Preliminary Report on Patentability issued in PCT/FI2005/050006.
International Search Report issued in PCT/FI2005/050006.

ARRANGEMENT IN A PAPER MACHINE

CROSS REFERENCES TO RELATED APPLICATIONS

This application is a U.S. national stage application of international app. No. PCT/FI2005/050006, filed Jan. 14, 2005, the disclosure of which is incorporated by reference herein, and claims priority on Finnish App. No. 20040049, filed Jan. 15, 2004, and also claims priority on Finnish App. No. 20045148, filed Apr. 23, 2004.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention relates to an arrangement in a paper machine or similar, which includes a press section equipped with one or more press nips and a dryer section comprising a web-supporting closed web transfer, a vertical impingement dryer and one or more subsequent cylinder dryer groups. The invention relates particularly to impingement unit applications blowing directly to the web.

With increasing paper machine speeds the runnability of the machine becomes very critical unless measures are taken at the same time for improving runnability. Runnability can be improved up to a certain limit by maintaining a sufficient web tension by means of a speed difference between successive stages. Even this method will become exhausted at the stage when the paper quality starts to deteriorate.

Rising paper machine speeds have led to a tendency to preferably use a closed transfer from the press section to the dryer section, and, particularly in a multicylinder dryer, the single fabric run arrangement, as far as possible, even to the end of the cylinder dryer. These are used to get rid of fluttering and similar phenomena, which occur in the free web transfer. From the center roll of the press section the paper web can however be picked up to the dryer section using an open transfer.

A paper machine dryer section using merely a multicylinder dryer becomes fairly long at high, 30 m/s to 40 m/s, speeds. According to Finnish patent 102623 (WO 97/130131) and Finnish patent application 20002429, impingement dryers are used to replace dryer cylinders, particularly at the beginning of the dryer section, in which full steam pressure cannot be used in dryer cylinders or steam supply of the first cylinder is sometimes even completely closed. A wet paper web attaches to a hot cylinder surface due to which it is necessary to use a lower cylinder surface temperature, whereat drying capacity is lost.

In an impingement drying unit, in which impingement takes place directly against the paper web and not through the fabric, it is possible to use fairly high blowing temperatures, 250° C. to 700° C., and thus achieve a very efficient heating effect. The paper web is set to travel on top of a support fabric, which is supported in the blowing area by a set of rolls either in a straight run or with a large curvature radius. Suction/blow boxes are placed between the rolls for keeping the paper web against the support fabric.

According to patent application 20002429 (WO 02/36880), it is possible to spare the machine-directional length by using one or more vertical impingement units. The support fabric has in the vertical direction a notably long loop compared to its machine-directional dimension, at least in the dryer cylinder line. The support fabric remains under the paper web as regards blowing and consequently is not subjected to heat. On both sides of the loop generally there are impingement units, both of which thus have a drying length of even several meters. Keeping the paper web attached to the support fabric is ensured by using internal suction devices, which direct the suction effect to the paper web from inside via the support fabric. The side profile of the impingement surface is straight, slightly curved, possibly variably curved, in a shape of a broken line or a combination of these.

The impingement unit comprises a web arrangement that provides support for the paper web and a blowing chamber, which has a perforation on its web side flank for distributing air or other hot gas onto the blowing surface.

Space saving is realized also in such a case when the orientation of the unit deviates even remarkably from the vertical, as it will in any case be located in a space below or above the paper machine. On the other hand, a vertical construction has the advantage that the earth's gravity cannot disturb the attachment of the fabric to the support surface.

In a closed transfer, a great number of fabric loops composed of support fabrics are needed. As the number and total length of these increase, web break risks generally increase. Therefore, the optimization of their number and lengths is aimed at.

Although the above-mentioned known impingement solutions have provided improvements compared to the prior art technique related to runnability at high speeds and the machine size in the longitudinal direction, the situation has not been completely satisfactory. A simpler, yet a reliable concept is still required.

The bulk, in units of $cm^3/g$, of paper is a significant quality factor for many paper grades. However, good bulk is in contradiction with the maximum press section dewatering, because achieving a high dry content after the press requires high nip pressures.

According to patent 102623, an impingement unit is located after the press section before the first dryer cylinder. Units blowing through a fabric according to the patent suffer from the blast air temperature limit, since the present drying fabrics cannot be stressed with blast air or steam hotter than 200° C. The construction becomes, however, relatively long, and the machine longitudinal saving is not notably achieved with simple solutions. With vertical impingement units according to patent application 20002429, remarkable savings are achieved much faster in the machine length. With the proposed solutions using vertical impingement units, the runnability is not better than today after the press section.

SUMMARY OF THE INVENTION

The object of the invention is to provide an improved arrangement in a paper machine, in which a vertical impingement unit is used. With the invention, elimination or at least minimization of the above-mentioned drawbacks is aimed at.

Impingement dryers are best used to replace exactly the first cylinder dryers, as their capacity remains rather poor due to a reduced steam pressure. Instead, there are no similar restrictions for straight impingement, and extraordinarily high temperatures can be used in it when blowing directly to the web. An efficient vertical impingement dryer requires however, for ensuring runnability, a pre-impingement dryer for drying the opposite side of the paper web at least to a certain extent and by running the moisture gradient growing towards the bottom surface. At the same time, the preceding efficient web heating enables the full drying capacity of a vertical unit. Preferably a vertical impingement dryer is unilaterally drying and directed to the same side as the first cylinder dryer such that full or almost full steam pressures can be applied starting from the first cylinder, that is, high drying temperatures on the cylinder surface without the risk of sticking.

Here "horizontal" and "vertical" should be understood widely as comprising a deviation of even 45°. In addition, the impingement surface can be curved or a polygon imitating a curved shape or a combination of these.

In another embodiment the top surface of the impingement chamber of the vertical impingement unit forms the pulper chute.

In a third embodiment the vertical impingement unit has several support rolls on top of each other, supporting the support fabric from the inside of the fabric loop. Between these rolls, there are arranged suction boxes in the web direction and in the vicinity of the fabric surface in a method known as such.

In a fourth embodiment, a pre-impingement dryer is placed over the section of the press transfer belt and the paper web is transferred therefrom directly to the fabric loop of the vertical impingement dryer. This is used to replace even two separate transfer fabric loops. This type of combination is particularly compact.

Pre-impingement follows immediately after the press is already on the press fabric or on the transfer or dryer fabric after the press. The rest of the machine design determines how near to the press, i.e. how compactly pre-impingement can be carried out.

The relative distances between the pre-impingement dryer, generally horizontal, and the vertical impingement dryer as well as the first dryer cylinder following those, are restricted by the fact that it is not desired that the web cools down excessively in the unheated section. In order to gain benefit from pre-impingement, the web must not cool down between the air blows, but the cooling effect of normal evaporation is still advantageous for the entity with dimensions given later. On the other hand, the web surface temperature should deviate less than 15° C., most preferably less than 8° C. from the dryer cylinder surface temperature, normally approximately 80° C. in a paper machine, to avoid harmful sticking of fibers etc. Normally it is allowed that this interval be 4 meters at the maximum, preferably less than 2 meters. In a compact construction, pre-impingement starts at a distance less than 2 meters, most preferably less than 1 meter from the press.

Higher steam pressures are used in board machines, thus the cylinder surface temperature can be as high as 130° C., whereat the deviations can also be greater. In addition, the cylinder may have a temperature profile, in which the edges are warmer than the rest of the cylinder, which can also be taken into account by profiling impingement and/or the steambox.

The invention can be fully utilized when a short pre-impingement dryer and a vertical impingement dryer are compactly installed between the press and the first cylinder group. Here a vertical impingement dryer equipped with two opposite units can be adapted to a short machine length, and the first dryer cylinder immediately following it can be adapted to essentially full steam pressures. More than one vertical impingement dryers cannot be compactly installed one after another in the machine direction, because the opposite hoods must be installed relatively far from each other. Instead, in addition to the underneath unit, it is possible to have opposite impingement units above the machine, as the arrangement does not increase the machine length.

The invention is described below in more detail by making reference to the enclosed drawings, which illustrate some of the embodiments of the invention.

DESCRIPTION OF THE PREFERRED EMBODIMENTS

Figure 1:
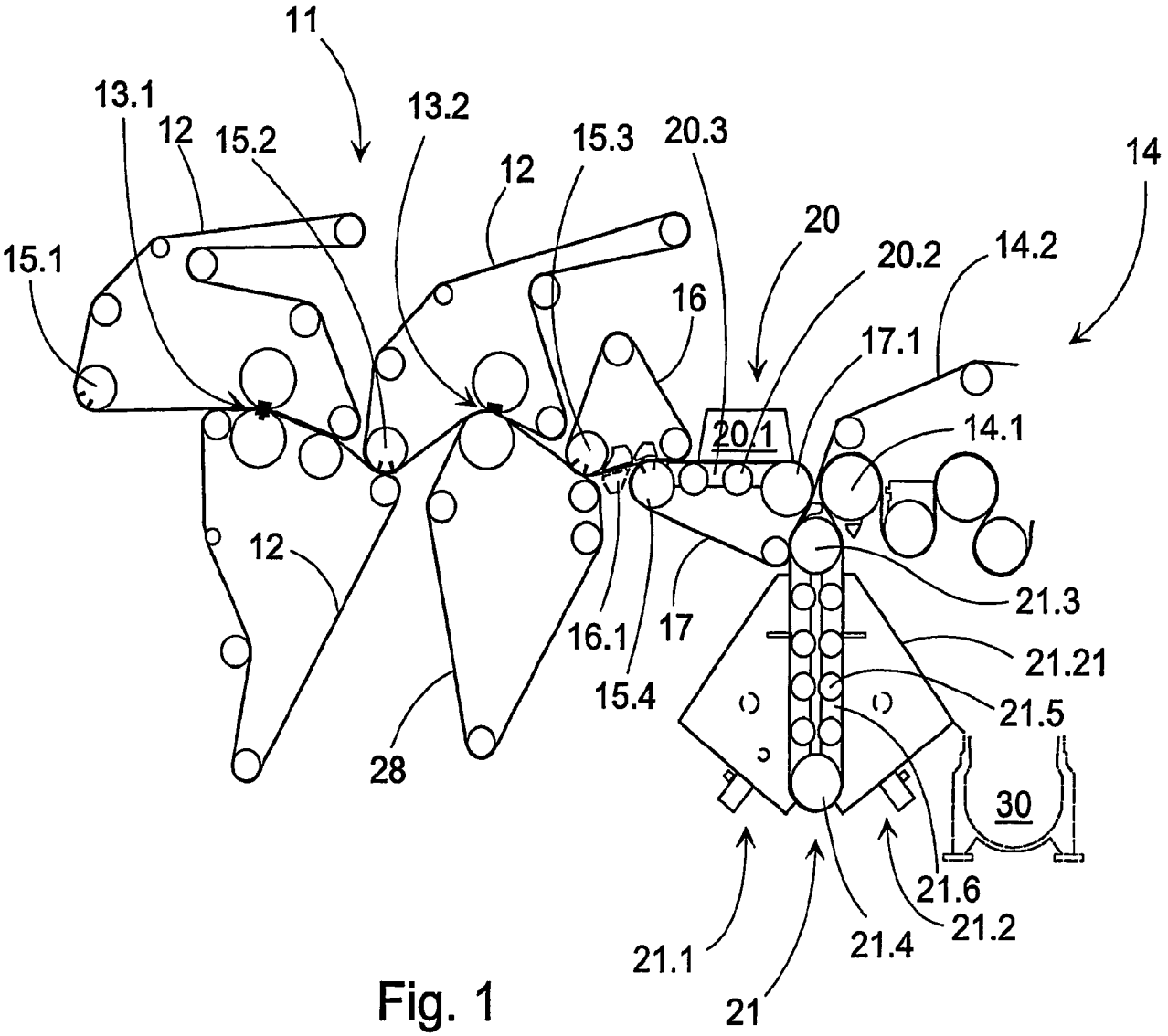
FIG. 1 illustrates an arrangement of a paper machine using impingement after the press.

FIGS. 1-4 depict a paper machine, in which shown are the press section 11 and some of the first sections of the dryer section, namely the pre-impingement dryer 20, vertical impingement dryer 21 and a beginning of the cylinder group 14. The first dryer cylinder is indicated with reference number 14.1.

The various parts of the arrangement, namely the press section, impingement dryers and cylinder dryers are known for their basic design from e.g. the above-mentioned patent publications.

The twin-nip press 11 has nips 13.1 and 13.2. The paper web is picked up in a known manner to the press section 11 with the pick-up roll 15.1 and it is transferred through the nips by means of the press felts 12 and the transfer belt 28. As regards this invention, the design of the press section can vary to a great extent. Particularly essential is however that after the press section 11, or integrated to its end part, there is a horizontal or pre-impingement dryer 20, which in FIGS. 1, and 3*a* uses the dryer fabric 17, against which the blowing unit 20.1 is placed. According to the prior art technique, in the center roll solution there is an open interval in the transfer from the press to drying, and with this embodiment, too, it is possible, irrespective of the press, to arrange an open/openable interval if required when shifting from impingement drying to cylinder drying.

Figure 3A:
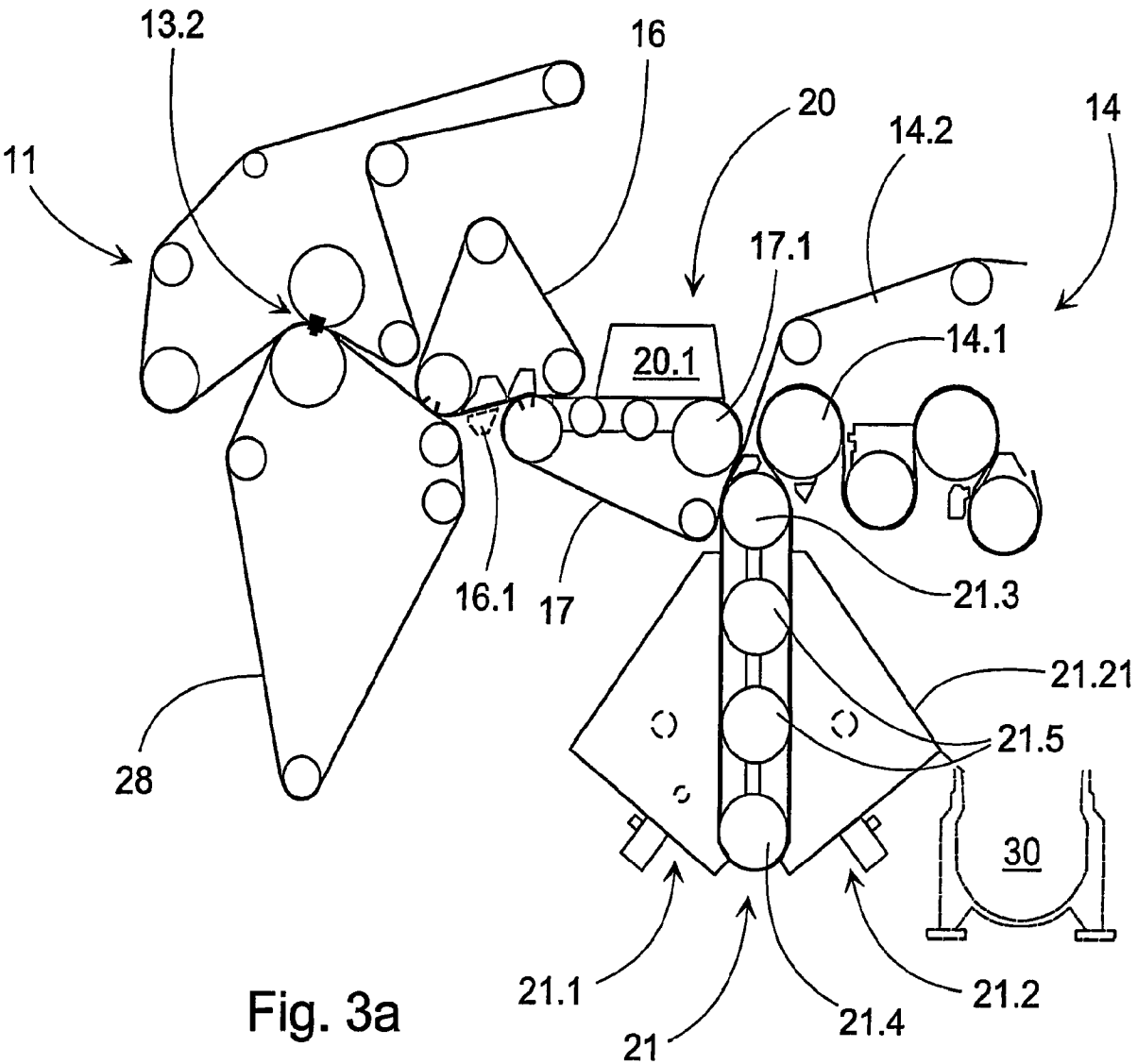
FIG. 3*a* illustrates a third arrangement according to the invention.

Referring to FIGS. 1 and 3*a*, the paper web is picked up from the transfer belt 28 with the transfer suction roll 15.3 and led to the transfer fabric 16, which transports it to the dryer fabric 17 of the horizontal impingement dryer 20 by means of the transfer suction roll 15.4.

The paper web travels on top of the dryer fabric 17 from below the blowing unit 20.1, whereat it is subjected to a strong heating effect. In a short blowing zone drying occurs relatively little, but the web warms up and its top surface layer dries slightly. This is however significant as regards the runnability. At the same time, the moisture gradient in the thickness direction of the web becomes strongly growing towards the bottom surface. Inside the dryer fabric loop 17 there are vacuum boxes 20.3 and support rolls 20.2 for keeping the web attached to the said fabric 17.

After the horizontal impingement dryer 20, the paper web is transferred from the dryer fabric 17 after the vacuum roll 17.1 onto the dryer fabric 14.2 of the first dryer cylinder group 14. This same dryer fabric 14.2 is also used by the vertical impingement dryer 21. In a method known as such, the paper web is transferred to the dryer fabric 14.2 by means of the topmost roll 21.3, functioning as a vacuum roll, suction roll or VAC roll, of the vertical impingement dryer 21. The roll 21.3 has a fabric wrap within an area of 3° to 10°. The dryer fabric 14.2 is supported in the straight section forming the blowing surface by several small support rolls 21.5, between which there are blow boxes 21.6 providing aspiration for creating a vacuum on the bottom surface of the transfer fabric, i.e. on the opposite surface of the paper web, whereat the paper web becomes aspirated against the transfer fabric 14.2.

The vertical impingement dryer 21 has two opposite impingement units 21.1 and 21.2, which are set on both sides of a narrow dryer fabric loop as seen from the side. The impingement surfaces are mainly delimited between the above-located roll 21.3 and the turning suction roll 21.4, although their hoods can extend to the curved section. Between these, on both surfaces, more precisely inside the fabric loop, there are support rolls 21.5 and blow boxes 21.6, such as is set forth for example in patent application 20002429. The support rolls can be grooved rolls, VAC rolls or suction rolls.

The center line of the vertical impingement dryer 21 deviates from the perpendicular by a maximum of 35°, such that it still saves machine-directional space. The pre-impingement predryer may deviate as much as 60° from the horizontal.

The temperature of the blast gas in the impingement dryers 20, 21 is preferably in a range of 200° C. to 700° C., most preferably in a range of 250° C. to 400° C. The steam of the steambox 16.1 used for the preheating of impingement drying is preferably slightly, normally 7° C., superheated and condenses on contacting the web, but not yet in the steambox. The web temperature can also be influenced by the impingement air moisture, air blow recirculation.

At the doctor of the first dryer cylinder 14.1 there is designed a web knock-down for web break situations. In this case the broke is conveyed to the pulper 30 along the upper flank 21.21 of the blowing unit 21.2 hood. In tail threading the web is run at full width to the pulper through the press and the impingement units. For tail threading, there is a tail squirt (not shown) located in the vicinity of the cylinder 14.1. In a center roll press, tail threading is carried out as a band over blowing units until to the said doctor.

In a normal situation the paper web travels with the dryer fabric 14.2 through the cylinder group to the subsequent group.

The impingement length of a horizontal impingement dryer is 50% at the maximum, most preferably 15% to 35% of the total web length of impingement. A greater pre-blowing length provides even drying in addition to preheating.

Figure 2:
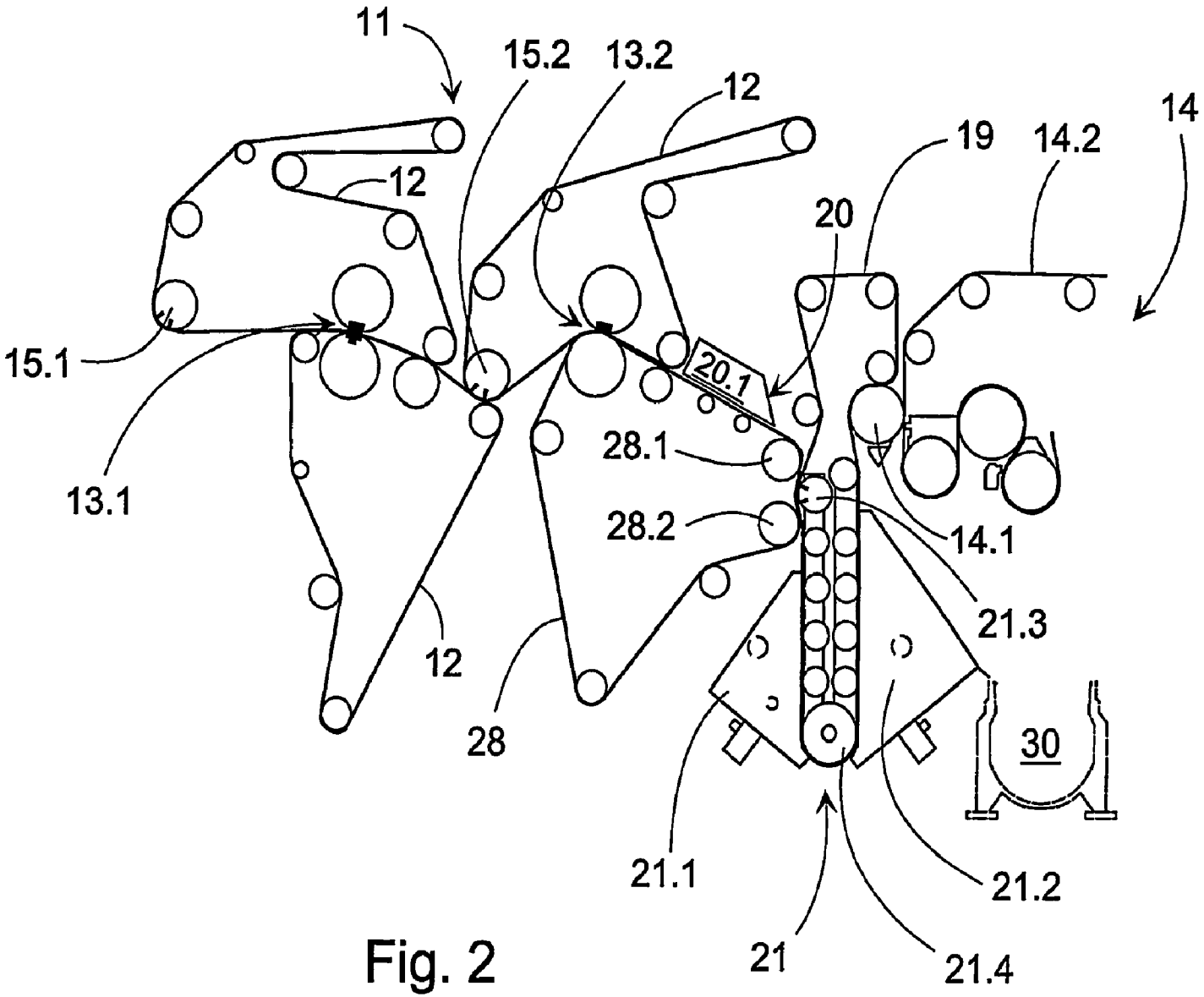
FIG. 2 illustrates another arrangement according to the invention.

FIG. 2 shows a preferable modification of the arrangement according to the invention as compared to FIG. 1. Functionally similar parts are referred to using the same reference numbers as above.

Here it has been possible to leave out two transfer fabric loops, as the horizontal impingement dryer 20 has been placed on the press transfer belt 28. From the transfer belt 28 the paper web is transferred to the dryer fabric 19 of the vertical impingement dryer. In FIG. 2 it is separate, but it can as well be a part of the dryer fabric 14.2 of the first cylinder group as above.

The paper web transfer from the transfer belt 28 to the dryer fabric 19 takes place in a method known as such. The turning roll 28.1 takes the fabric loops together and the transfer suction roll 21.3 picks up the paper web onto its own dryer fabric 19. When the vertical impingement dryer is equipped with a fabric loop of its own, an additional transfer point is provided in connection with the first cylinder, at which transfer point it is possible to use a speed difference for maintaining runnability. This has a particular importance when the dry content is lower, such as is set forth below.

Generally at a vertical impingement unit:

An own fabric loop is arranged when the subsequent web dry content is 48% to 54%, or A fabric loop common with the short, i.e. a maximum of 3 dryer cylinders, dryer cylinder group when the dry content after the blowing units is 52% to 57%, or A fabric loop common with the long, i.e. 4 or more cylinders, dryer cylinder group when the dry content after the blowing units is 56% to 65%.

It should be noted that for quality reasons, e.g. with a weak furnish/web or in an embodiment according to FIG. 2, it is possible, if necessary, to use an own fabric loop also with a higher dry content, arranging thus one additional transfer point.

The arrangement of FIG. 3*a* is for the main part similar as in FIG. 1. The design of the impingement unit is however simplified such that inside the dryer fabric loop, between the auxiliary turning roll 21.4 and the vacuum roll 21.3, support rolls 21.5 of the same size as these rolls are used, which are preferably vacuum rolls, being actually the same as the turning suction rolls of the dryer cylinder. The suction boxes between these are of the same type as above. Depicted with broken lines in this figure is also a possible steambox 16.1, the use of which provides completely new possibilities in impingement. In this figure it is located below the web, but it would also be possible to replace the first impingement box completely with the steambox. The application possibilities of the steambox are discussed below. In one modification the support rolls 21.5 are larger than rolls 21.3 and 21.4 such that the fabric touches the rolls for a longer distance. This improves the suction effect, which enhances further the runnability.

The arrangement according to the invention can be used to improve the paper value for certain grades, in which the paper's bulk is significant. According to FIG. 4, dry content and bulk after press correlate inversely in different paper grades. Instead of using high nip pressures of 1000 kN/m at the press, the nip pressures are reduced in the first and second nip to a range of 400 kN/m to 800 kN/m. With the invention, drying of 1% to 2% of dry matter is transferred from the press section to impingement such that the paper's bulk is maintained. The increase in dry content for the impingement stages is preferably 3% to 12% in total before the dryer cylinders, more precisely 400%±100%/basis weight, g/m$^2$, where a large range of fluctuation compensates the effect of the paper machine speed on the dry content.

With the invention, runnability is maintained, although the draw difference between the press and the first cylinder is set below 2.9%, most preferably below 2.5%, irrespective of the fact that the web is dried with impingement blows and is possibly transferred from a fabric to another even more than once.

Figure 3B:
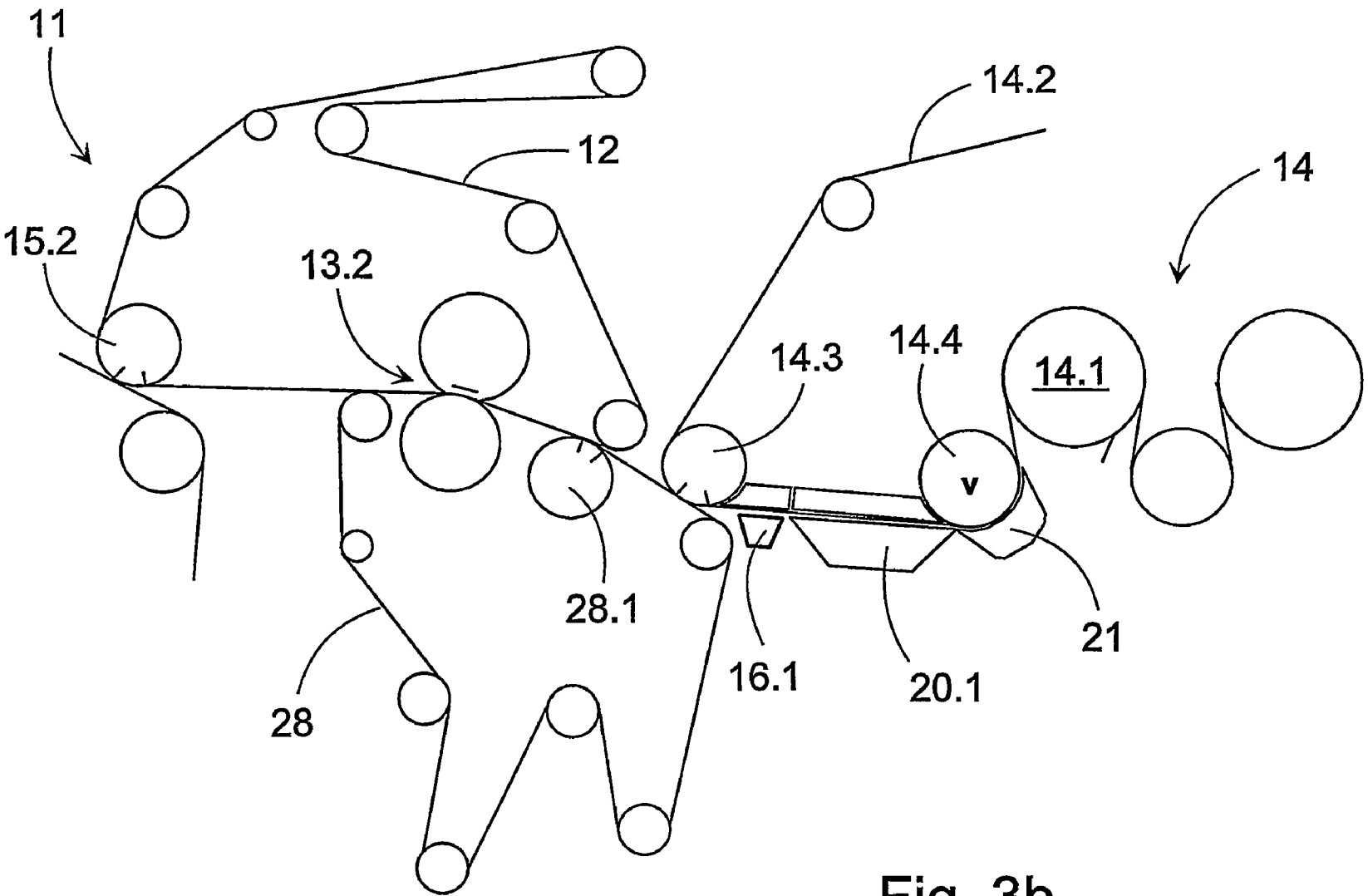
FIG. 3*b* illustrates another embodiment using a steambox.
Figure 4:
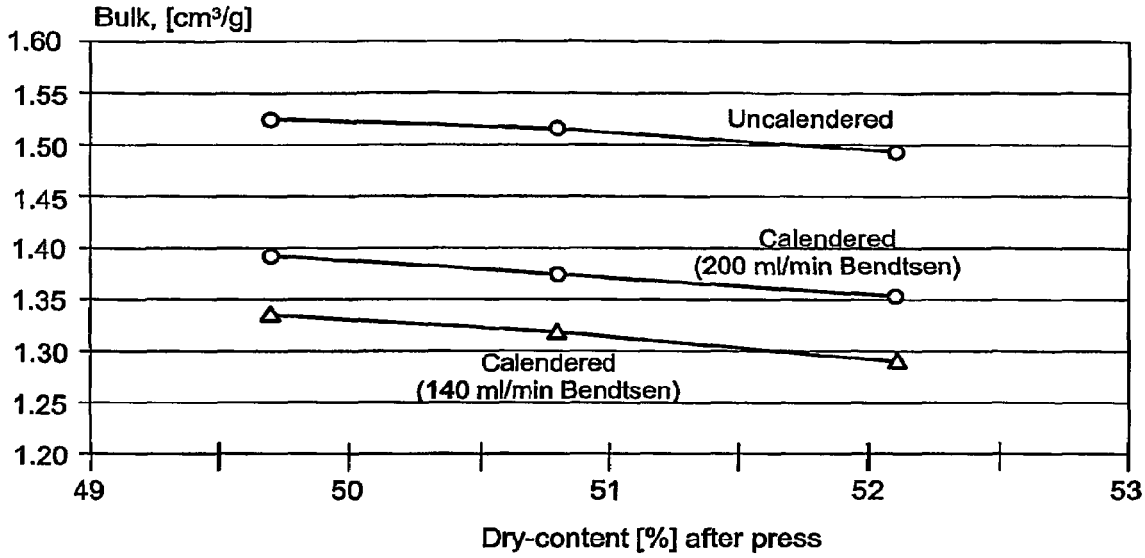
FIG. 4 is a diagram showing the interdependencies between bulk after press and dry matter for some paper grades.

FIG. 3*b* shows another steambox application, in which all impingement blows are on the same side of the paper web, because pre-impingement is carried out with steam. Reference numbering corresponds to the previous figures for applicable parts. Here installed on the fabric 14.2 of the first dryer group 14 there are also a steambox 16.1, vertical, i.e. straight, impingement unit 20.1 and the impingement unit 21 of the vacuum roll, before the first dryer cylinder 14.1. The paper web travels on the bottom surface of the fabric 14.2, onto which it has been transferred with the transfer suction roll 14.3. The steambox 16.1 efficiently increases the paper web temperature and consequently even a short impingement section dries the web surface on the cylinder side preventing it from attaching to the first dryer cylinder. By lowering the vacuum roll 14.4, the impingement length can be increased in this embodiment, too, approaching thus the combination of preheating and vertical.

Differing from gas operated impingement, the steambox can be better located on the same side of the paper web as vertical impingement, because the heating effect provided by steam condensing is particularly strong compared to gas convection. The steambox is profiling already as such, but it can be further divided into accurately profiling compartments in the cross-machine direction. Although condensing brings water to the paper web, this is not a great drawback when using impingement, because the paper web surface can in any case be made drier than without it, allowing full pressures in the first dryer cylinder.

The following advantages are associated with the use of a steambox:

- Known as such as a process and currently used at the press. The steambox creates a temperature profile and drying continues more intensive from warmer places in the dryer section. The phenomenon is intensified with the proposed arrangement.
- More accurate, precise and efficient moisture profile control, compared to the traditional steambox use at the press, because the web does not get wet again after profiling.
- Increased drying capacity, since the web temperature is raised by 20° C. to 30° C. before impingement.
- The moisture profile is controlled throughout the entire dryer section, as warmer places dry faster than the cold ones.
- Enables better optimization of press loads e.g., in solutions requiring bulk load reduction at press.

FIGS. 5-10 show embodiments of the second group of the invention and equal reference symbols are used for corresponding parts unless otherwise indicated.

Figure 5:
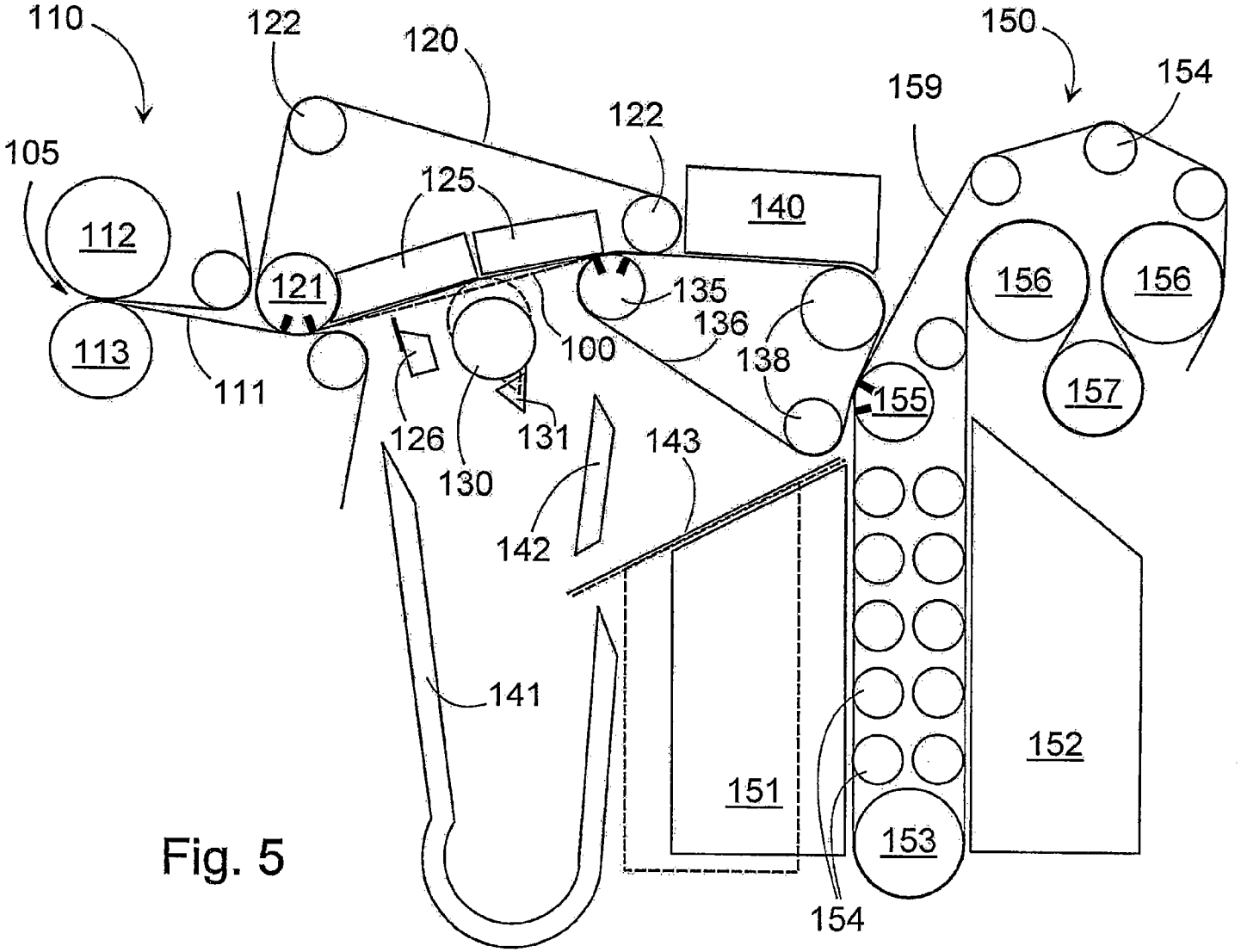
FIG. 5 is a diagram showing an embodiment of the second group of the invention.

In the embodiment according to FIG. 5, the web 100 is led from the press section 110, from the last press nip 105 thereof, which has been formed between rolls 112, 113, on the surface of the last fabric, most appropriately on the surface of a transfer belt or felt 111, to the first transfer fabric 120, to which the web 100 is transferred by means of the pick-up roll 121. On the transfer fabric 120 the web transfer is supported by blow boxes 125, which are most appropriately blow boxes of the type marketed by Metso Paper, Inc. with the trademark PressRun. Followed by this there is a tail squirt 126 or a similar element for cutting a web threading tail, which is followed by a roll 130, with a movable position, which is most appropriately smooth and equipped with a doctor 131. For the tail threading, the roll 130 with a movable position is lifted to the top position, as shown with broken lines in the figure. From the smooth roll 130 the web is doctored with the doctor 131 to the pulper 141 during tail threading. The web travel to the pulper is ensured by a guide plate 142, and the chute 143 guides the web that has advanced any further to the pulper 141 in a disturbance/when required. The chute 143 can also be separate from the impingement hood 151 and comprises water showers for guiding the web to the pulper 141. From the first transfer fabric 120 the web is led to a second transfer fabric 136, onto which the web is transferred by means of the transfer suction roll 135. This can be followed by an impingement drying unit 140 located above the web on the transfer fabric 136. The guide and lead rolls of the first transfer fabric loop are indicated with reference number 122. The guide and lead rolls of the second transfer fabric loop are indicated with reference number 138. From the second transfer fabric 136 the web is led to vertical impingement drying, onto its dryer fabric 159, with which the web is transferred via the transfer suction roll 155. The guide and lead rolls of the dryer fabric loop 159 are indicated with reference number 154. First the web travels essentially vertically downwards, whereat it is dried with the impingement unit 151, after which the web travel direction is reversed at roll 153, after which the web 100 travel is essentially vertically upwards, during which travel it is dried by means of air blows provided by the impingement unit 152. After this the web is led on the dryer fabric 159 to cylinder drying, where the web 100 to be dried remains between the dryer fabric 159 and the heated cylinder surface 156 and the web 100 travel conforms to a normal single fabric run, whereat its travel is windingly turned with turning rolls or turning cylinders 157. The transfer suction rolls can also be moved to the tail threading position for the duration of tail threading of the web. For the transfer suction rolls, this position is also the standard operating position, such that tail threading and normal operation differ as regards the vacuum levels of the transfer suction rolls in that generally the vacuum used during tail threading is higher.

Exemplifying embodiments of the invention shown in the following FIGS. 6-8 correspond to the exemplifying embodiment of FIG. 5 unless otherwise indicated.

Figure 6:
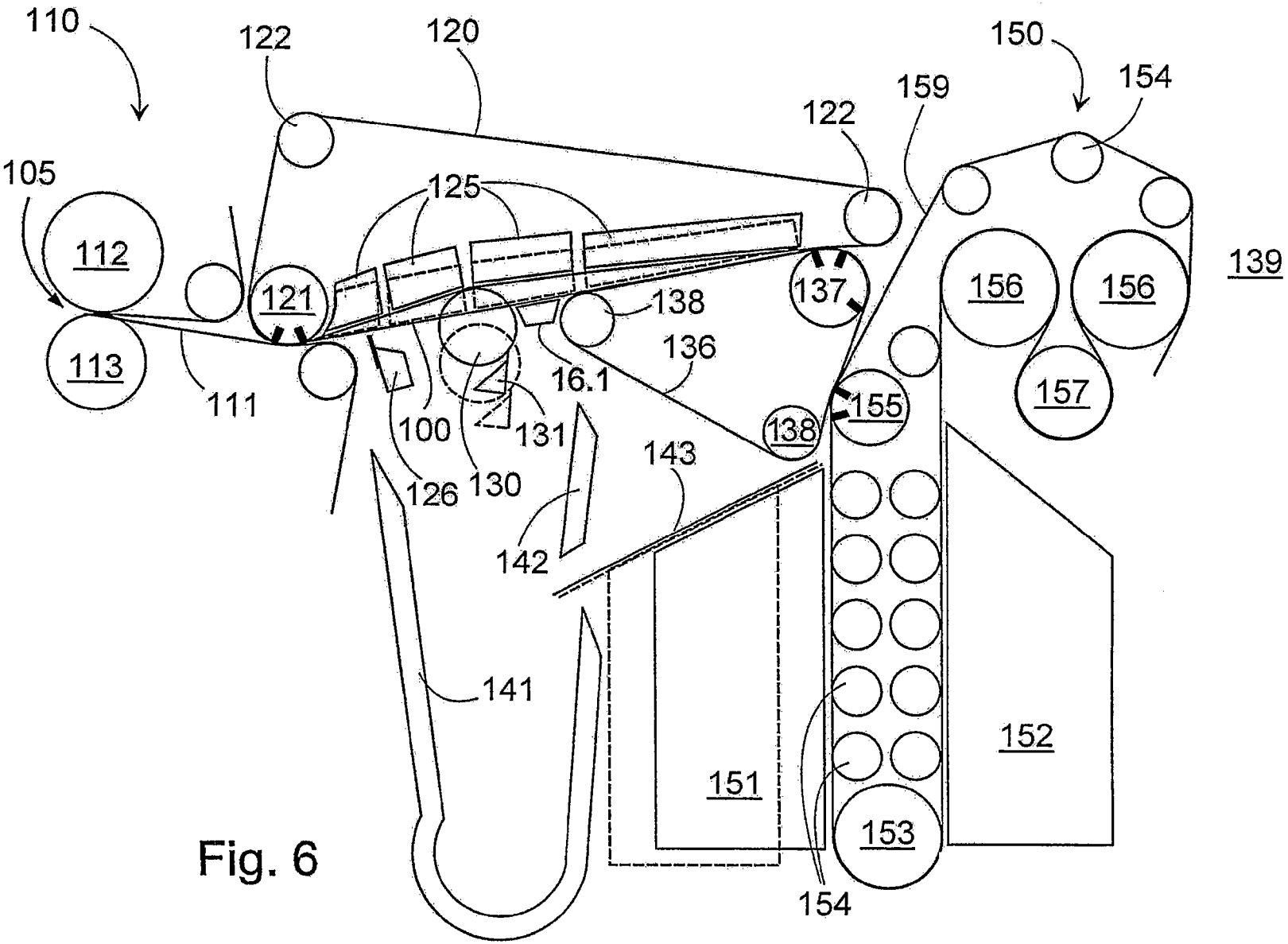
FIG. 6 is a diagram showing the second embodiment of the second group of the invention.

In the embodiment shown in FIG. 6 the web travel is essentially lineal and this has been so arranged that the second transfer fabric 136 extends to the area of the first transfer fabric loop 120 providing for the web a bilateral support, which allows arranging the web travel as essentially lineal. In this embodiment the web is transferred to the transfer fabric 136 with the transfer suction roll 137 and further to the dryer fabric 159 of the impingement drying group with the transfer suction roll 155. In this embodiment the first transfer fabric loop 120 is equipped with blow boxes 125, which are used to guide the web travel.

Figure 7:
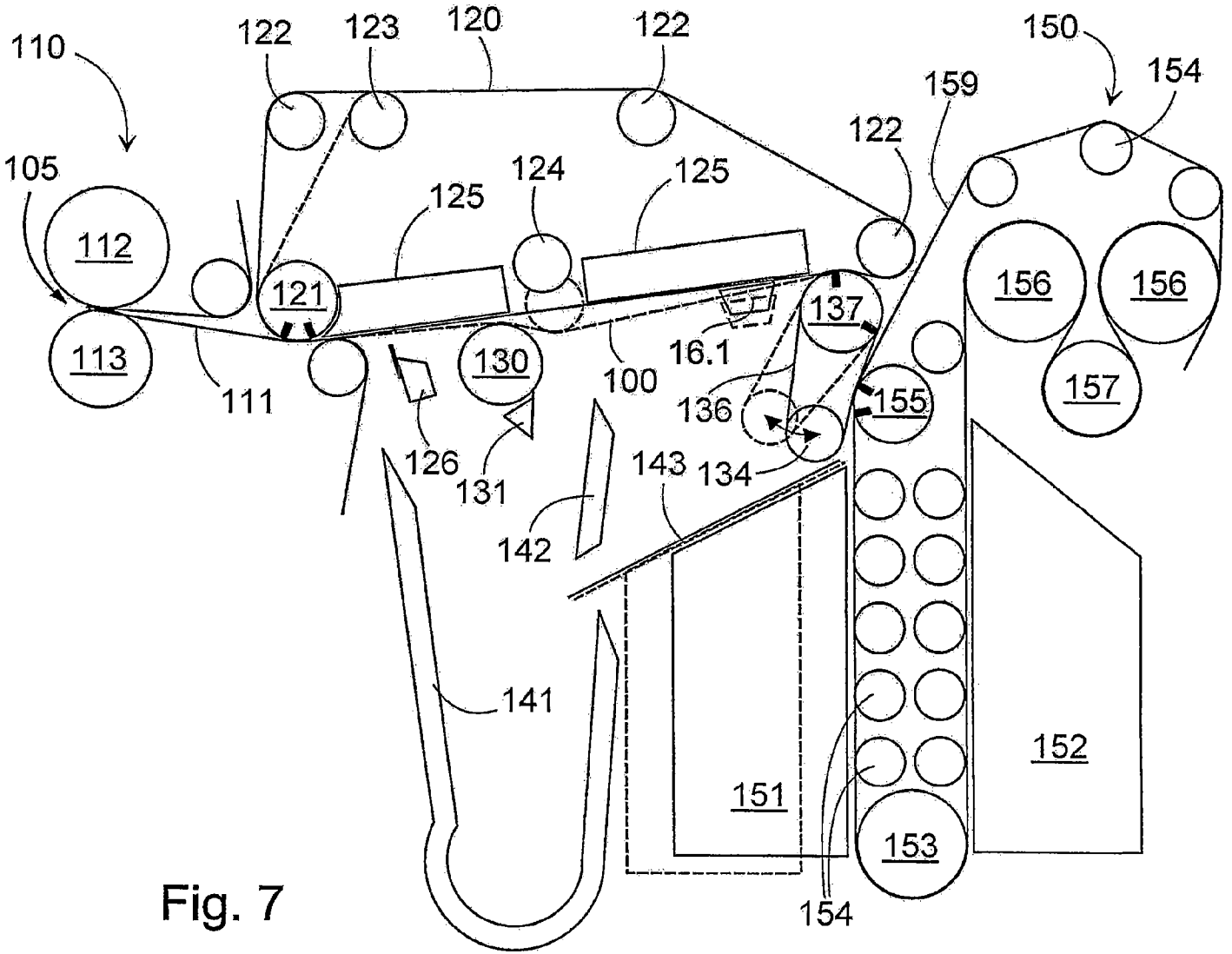
FIG. 7 is a diagram showing the third embodiment of the second group of the invention.

In the embodiment shown in FIG. 7, the roll with a movable position is located inside the first transfer fabric loop 120 and it is indicated with reference number 124, as it simultaneously forms one of the guide and lead rolls of the transfer fabric loop during tail threading. Because this roll is movable, the transfer fabric loop is additionally provided with another roll 123 with an adjustable position for maintaining the tension of the transfer fabric loop 120. In the embodiment shown in FIG. 7 the second transfer fabric loop 136 transports the web 100 only for a short distance mainly in the area of the transfer suction roll 137 and for a short section before the web 100 encounters the dryer fabric 159 of the impingement dryer group at the transfer suction roll 155. The other roll 134 of the transfer fabric loop 136 is movable for its position, as is illustrated in the figure with an arrow and the transfer position marked with broken lines. Thus the transfer fabric loop 136 can be moved away from contact with the transfer suction roll 155 of the impingement drying group such that the web 100 can be led to the pulper via the chute 143 in a disturbance/when required.

Figure 8:
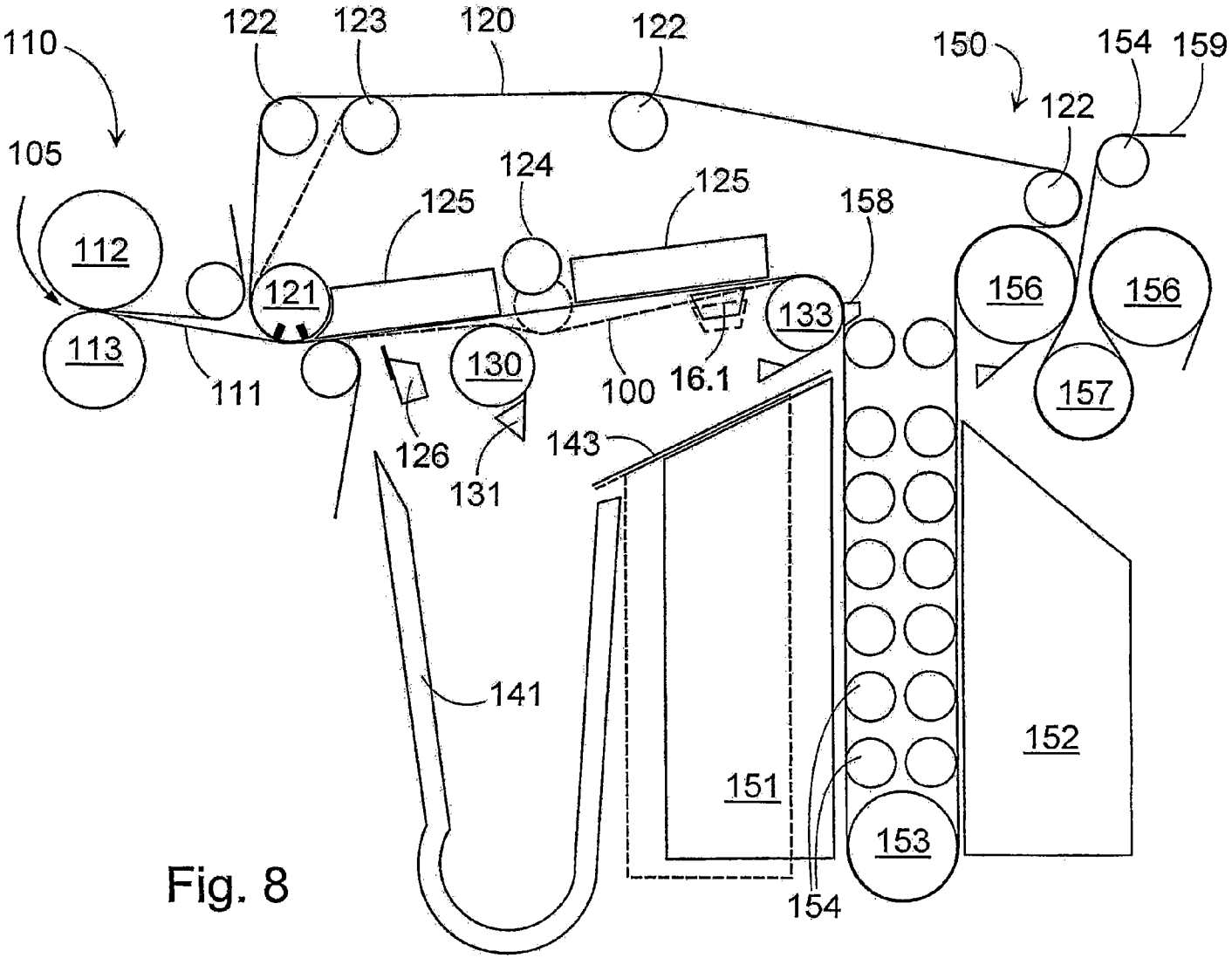
FIG. 8 is a diagram showing the fourth embodiment of the second group of the invention.

In the embodiment shown in FIG. 8 the transfer fabric 120 is simultaneously the dryer fabric of the vertical group, which reduces the number of transfer points and thus the need of transfer suction rolls. The roll 133 is preferably a blow roll, and the suction box 158 can also make sure that the web 100 follows the fabric 120 in the downwardly fabric travel. In this way it is at the same time possible to increase the length of the impingement drying section. The roll 133 is preferably a blow roll, but by intensifying the vacuum device 158 it is possible to locate even a cylinder in this position, which however in a tail threading situation may be a slightly less advantageous alternative, because then it is necessary to controllably use the cylinder on the opposite side of the blow roll only over the width of the proceeding band. In case the roll 133 is a blow roll, it can be for example a warm blow roll, approximately 140° C. inside the roll, or the roll can be a grooved roll, the groove size of which is 1×1 mm and then its effect is intensified with the vacuum device 158.

In the embodiments of FIGS. 6-8 impingement drying is carried out with steamboxes according to FIG. 3*b*.

Referring to the embodiments of FIGS. 5-8, the web dry content is raised in the dryer section of a paper machine to a sufficient value, being typically 50% to 65% of dry matter, even 70% of dry matter before dryer cylinders are used for drying. According to the invention the paper web is thus dried after the press section with impingement drying in a vertical impingement drying group before cylinder drying. According to the invention, in the method the paper web is led from the press section to the vertical impingement drying group from the last fabric of the press section, i.e. a transbelt or a felt, by means of at least one transfer fabric.

In connection with the invention, especially FIGS. 5-8, arranged in connection with at least one transfer fabric used for leading the web from the press section to the first vertical impingement drying group of the dryer section, there is preferably a roll with a movable position or similar, for example, which for the duration of tail threading is moved to the tail threading position, most appropriately to the top position, and after tail threading to a position, in which it does not affect the web travel. The section of the web to be led from the movable roll to the pulper can be selected for example by moistening the roll over this desired width, thus the tail position in the roll continuing further in tail threading would be dry, and correspondingly it is possible to moisten the roll over the entire width when running down the entire wide web. Arranged in connection with the transfer fabric there are preferably blow boxes, providing a vacuum effect, by means of which the web is kept in the conveyance of the transfer fabric. According to one preferable additional feature of the invention, the first transfer fabric is followed by a second transfer fabric, which is located below the web and by means of which the web is led to the dryer fabric of the vertical impingement drying group.

According to one preferable embodiment of the invention, the web is led from the last press nip of the press section on the surface of the last fabric, most appropriately a transbelt or a felt, from which the web is transferred to the first transfer fabric. The web transfer is then followed by a tail squirt or other similar device for cutting a web threading tail. This is followed by a roll with a movable position, most appropriately a smooth roll, associated with a doctor. The web is run at full width from the pick-up roll of the first transfer fabric loop, i.e. from the roll that picks it up from the previous fabric, to the roll with a movable position, which has been moved to the tail threading position, to the top position, while the pick-up roll goes down and picks up the web from the last fabric of the press section. Because the transfer fabric covers a part of the roll with a movable position, the web follows the roll and arrives at the roll doctor, from where it slides down to the pulper. After this the concept includes a second transfer fabric, which is used to take the web to the dryer fabric of the vertical impingement drying group. The drying effect of the vertical impingement drying unit is such that the web dry content can be raised to a level of 50% to 65% of dry matter, most appropriately 55% to 63% of dry matter, before leading the web to cylinder drying. The roll with a movable position is in the top position while the web threading tail is transported over the vertical impingement unit, and once the web is widened, the roll with a movable position is lowered to a position unaffecting the web travel, to the bottom position such that it does not create a problem point as regards the opening gap, as in this case an opening gap, in which a vacuum complicating runnability that is harmful for the web travel would otherwise be created, is not formed. Located inside the loop of the first transfer fabric there are blow boxes, most appropriately boxes of the type marketed by Metso Paper, Inc. with the trademark PressRun, for ensuring the web travel.

Figure 9:
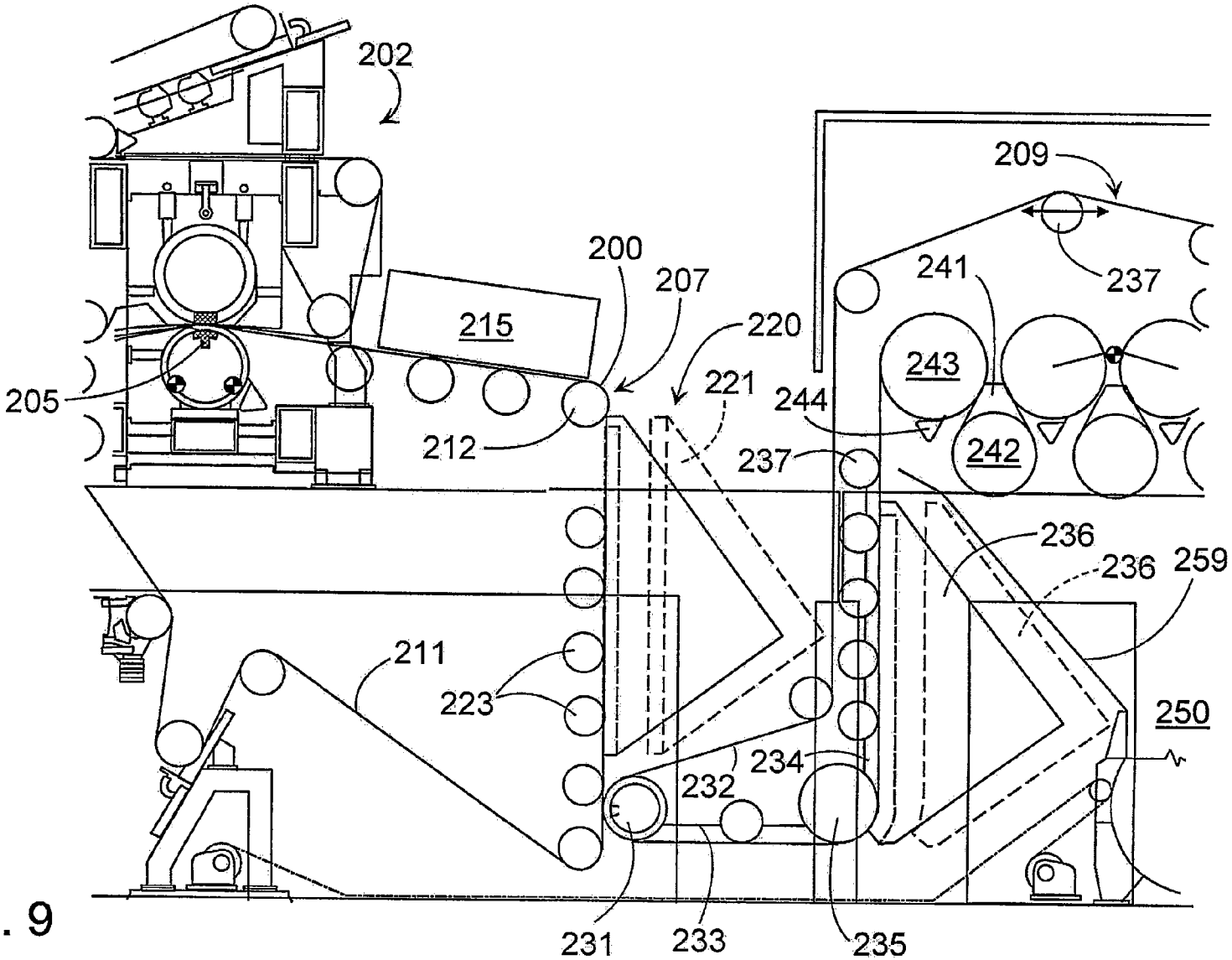
FIG. 9 is a diagram showing the fifth embodiment of the second group of the invention.

In the exemplifying embodiment of the invention shown in FIG. 9, the web 200 is led from the press section 202, from the last nip 205 thereof, with the bottom fabric 211 of the press to position 207, in which the web 200 travel takes a steep curve downwards at the roll 212 to vertical impingement drying 220, in which the web 200 is dried, in the downwardly section thereof, by means of drying air blows provided by the impingement drying unit 221. The lead and guide rolls of the fabric 211 are indicated with reference number 223. Located in the section between the last press nip 205 and position 207 there is the impingement drying unit 215 for pre-impingement, which preferably provides more drying blow length for impingement drying. According to this embodiment, too, when using the last press section fabric 211, savings are made in fabric arrangements and the related roll arrangements. After the downwardly impingement drying 220, the web 200 is led onto the dryer fabric 232 of the first dryer group 209, on which the web 200, after the horizontal section, in which the web 200 is supported by vacuum boxes 233, is first turned by means of roll 235 to vertical upwardly impingement drying 230, whereat the web 200 is dried with drying air blows provided with the impingement drying unit 236, after which the web 200 is taken to cylinder drying applying the single fabric run arrangement, in which the web 200 windingly travels on the dryer cylinders 243 and the suction or turning cylinder 242. The runnability of the web 200 is intensified by the vacuum components 241. In a knock-down situation, such as tail threading and web break, it is possible to lead the web 200 from the cylinder drying section 209 to the pulper 250 at one of its first dryer cylinders. The pulper chute is indicated with reference number 259.

Figure 10:
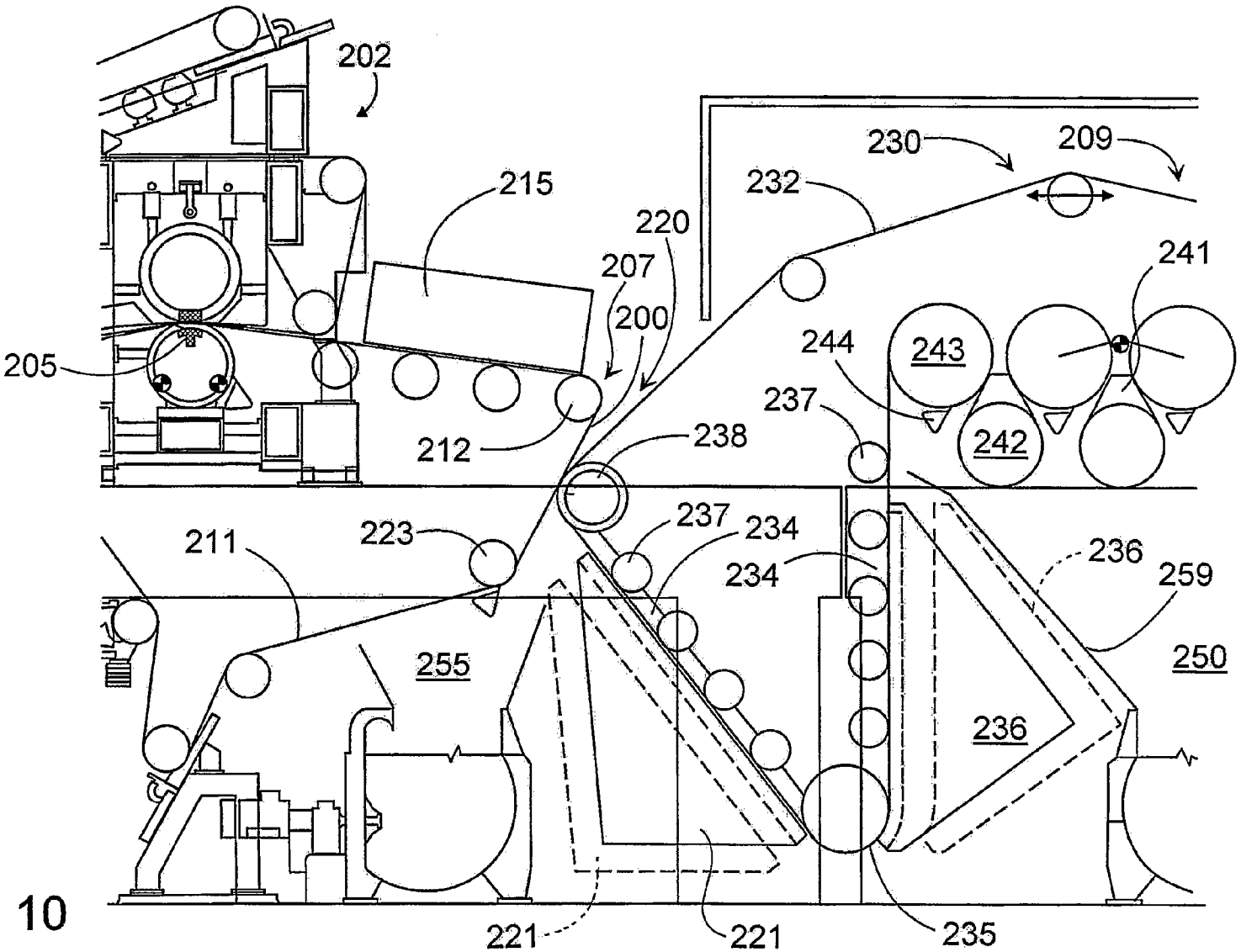
FIG. 10 is a diagram showing the sixth embodiment of the second group of the invention.

In the embodiment of the invention shown in FIG. 10, the web 200 is led from the last press nip 205 of the press section on the surface of the last bottom fabric 211 of the press section, where the press nip 205 is first followed by pre-impingement in the horizontal impingement drying unit 215, after which in position 207 the web 200 takes a curve downwards at roll 212 on fabric 211, from which it is picked up onto the dryer fabric 232 of the first dryer group 209 with the transfer suction roll 238 and the web 200 is led to vertical impingement drying 220, in which the web 200 is dried in an essentially downwardly section by means of drying air blows provided by the impingement drying unit 221. Keeping the web 200 attached to the fabric 232 surface is facilitated by the vacuum boxes 234. The web 200 travel is turned to an essentially upwardly direction at roll 235, in which upwardly travel the web 200 is dried with vertical impingement drying 230 by means of drying air blows provided by the impingement drying unit 236, after which the web 200 is led to cylinder drying applying the single fabric run arrangement. The pulper is indicated with reference number 250 and the pulper chute with reference number 259. In a knock-down situation the web 200 is led to the pulper 250 from one of its first cylinders of its first dryer group. This embodiment of the invention enables locating another pulper 255 after the press section 202 before vertical impingement drying 220.

In one simulation the paper grade used was fine paper, 78 g/m$^2$, a pre-impingement length of 6 m, and the paper temperature coming from the press section has been assumed to be 45° C. In this case preblowing warms up the web to 74° C. This is followed by 2.7 meters of blowless run while moving to the subsequent fabric and to a new impingement unit, whereat the web temperature falls to 65° C., that is, approximately 9° C. is lost from the temperature increase of 29° C. Over six meters the decrease is 6.5° C. or more. Over a blowless interval of 8 meters the web temperature decreased further to 55.5° C., i.e. by 19.5° C. Lighter paper cools down faster and heavier paper correspondingly cools down slower. This blowless length varies due to, for example, the web transfer geometry, moving from a fabric to another, the space required by the lead rolls, or the required transfer fabric.

The invention claimed is:

1. A method of improving runnability and allowing for shortened dryer section of a paper or board machine comprising the steps of:

after pressing a paper or board web in a press nip of a pressing section, drying a first side of the paper or board web by blowing air or other hot gas of a temperature of 250° C.-700° C. directly on to the first side of the paper or board web in a pre-impingement dryer in which impingement takes place directly against the paper or board web and not through a fabric;

within a maximum distance of 4 meters of the pre-impingement dryer, drying the second side of the paper or board web in a second impingement dryer with blowing air or other hot gas of a temperature of 250° C.-700° C. on two sides of a loop formed by a support fabric, wherein the loop is in the vertical direction longer than its machine-directional dimension and is arranged such that the support fabric remains on the side of the paper or board web opposite blowing air;

keeping the paper or board web attached to the support fabric using internal suction devices, which direct a suction effect to the paper web from inside the support fabric;

within a maximum distance of 4 meters of the second impingement dryer, drying the second side of the paper or board web in a first group of steam heated dryer cylinders;

contacting the web second side to a drying surface of a first dryer cylinder of the group of steam heated dryer cylinders having a temperature of approximately 80° C. and up to 130° C., wherein said drying surface is the drying surface of the first group of steam heated dryer cylinders to first contact the web; and wherein the paper or board web is heated by the second impingement dryer to a temperature which deviates less than 15° C. from the drying surface of the first dryer cylinder of the first group of steam heated dryer cylinders.

2. The method of claim 1 wherein the press nip is a last press nip in the press section, and further comprising the step of using a draw difference from said last press nip of the press section to the first dryer cylinder below 2.9%.

3. The method of claim 1 wherein the press nip is a last press nip in the press section, and further comprising the step of using a draw difference from said last press nip of the press section to the first dryer cylinder below 2.5%.

4. The method of claim 1 wherein the paper or board web is dried to a content-moisture in the range of 48% to 54% in the second impingement dryer, and a fabric loop is employed in the second impingement dryer that is not common with the first group of steam heated dryer cylinders.

5. The method of claim 1 wherein the paper or board web is dried to a content-moisture in the range of 52% to 57% in the second impingement dryer and a fabric loop is employed in the second impingement dryer which is common with the first group of steam heated dryer cylinders.

6. The method of claim 1 wherein the paper or board web is dried to a content-moisture in the range of 56% to 65% in the second impingement dryer and a fabric loop is employed in the second impingement dryer which is common with the first group of steam heated dryer cylinders which has at least four dryer cylinders about which the loop formed by a support fabric is wrapped.

7. An arrangement in a paper or board machine comprising:

a pressing section;

a paper or board web having a first side and a second side opposite the first side;

a pre-impingement dryer connected to a source of blowing air or other hot gas of a temperature of 250° C.-700° C., the pre-impingement dryer arranged to direct air or other hot gas from the source of blowing air or other hot gas against the first side of the paper or board web and not through a fabric;

wherein the paper or board web extends from the pressing section through the pre-impingement dryer;

a second impingement dryer connected to a source of blowing air or other hot gas of a temperature of 250° C.-700° C., the second impingement dryer within a maximum distance of 4 meters of the pre-impingement dryer, and positioned about the second side of the paper or board web which is positioned on two sides of a loop formed by a support fabric, wherein the loop extends vertically a distance greater than the loop extends in a machine direction and the support fabric is arranged such that the support fabric is on the side of the paper or board web opposite the second impingement dryer;

a plurality of internal suction devices, positioned inside the loop formed by the support fabric so as to direct a suction effect to the paper or board web;

a first group of steam heated dryer cylinders connected to a source of heated steam within a maximum distance of 4 meters of the second impingement dryer;

wherein the second side of the web extends from the second impingement dryer to first contact the first group of steam heated dryer cylinders on a drying surface of a first dryer cylinder of the first group of steam heated dryer cylinders having a temperature of from approximately 80° C. and up to 130° C.;

wherein the paper or board web between the second impingement dryer and the drying surface of the first dryer cylinder has a temperature which is within 15° C. of the temperature of the drying surface of the first dryer cylinder of the first group of steam heated dryer cylinders where the paper or board web is adjacent to the drying surface of the first dryer cylinder.

8. The arrangement of claim 7 wherein the pre-impingement dryer has a first impingement length and the second impingement dryer has a second impingement length and a total impingement length is defined as the sum of the first impingement length and the second impingement length, and wherein the first impingement length is equal to or less than 50%, of the total impingement length.

9. The arrangement of claim 8 wherein the first impingement length is 15-35% of the total impingement length.

10. The arrangement of claim 7 wherein the pre-impingement dryer is straight and has an inclination from the horizontal of 0-60 degrees.

11. The arrangement of claim 7 wherein the pressing section has a last nip, and associated with said last nip of the pressing section there is a loop formed by a transfer belt, wherein the pre-impingement dryer is set on the transfer belt.

12. The arrangement of claim 7 wherein the second impingement dryer further comprises:

the loop formed by the support fabric having an inner side and an outer side; and a plurality of rolls inside the loop formed by the support fabric supporting and leading the paper or board web downwardly.

13. The arrangement of claim 7 wherein the second impingement dryer defines a center line which deviates at most 35° from a perpendicular.

14. The arrangement of claim 7 wherein the pre-impingement dryer further comprises a steambox.

15. The arrangement of claim 7 wherein the pre-impingement dryer is of the gas-operated type.

16. The arrangement of claim 7 wherein the second impingement dryer further comprises a fabric loop that is not common with the first group of steam heated dryer cylinders.

17. The arrangement of claim 7 wherein the second impingement dryer further comprises a fabric loop that is common with the first group of steam heated dryer cylinders, and wherein the first dryer group of steam heated dryer cylinders has a maximum of three dryer cylinders.

18. The arrangement of claim 7 wherein the second impingement dryer further comprises a fabric loop that is common with the first group of steam heated dryer cylinders, and wherein the first group of steam heated dryer cylinders has four or more dryer cylinders.

* * * * *